US005857874A

United States Patent [19]

Takeuchi

[11] Patent Number: 5,857,874

[45] Date of Patent: Jan. 12, 1999

[54] TERMINAL STRUCTURE FOR CONNECTION TO ELECTRIC CONNECTION BOX

[75] Inventor: Kunihiko Takeuchi, Shizuoka-ken, Japan

[73] Assignee: Yazaki Corporation, Tokyo, Japan

[21] Appl. No.: 757,091

[22] Filed: Nov. 26, 1996

[30] Foreign Application Priority Data

Nov. 28, 1995 [JP] Japan ..... 7-309208

[51] Int. Cl.[6] ..... H01R 13/68

[52] U.S. Cl. ..... 439/621

[58] Field of Search ..... 439/621, 622, 439/752, 801

[56] References Cited

U.S. PATENT DOCUMENTS

| | | | |
|---|---|---|---|
| 1,227,753 | 5/1917 | Cole | 439/621 |
| 4,174,147 | 11/1979 | Waddington et al. | 439/801 |
| 4,464,005 | 8/1984 | Dwight | 439/621 |
| 4,560,227 | 12/1985 | Bukala | 439/621 |
| 4,804,341 | 2/1989 | Kato et al. | 439/752 |
| 5,314,354 | 5/1994 | Nomura et al. | 439/621 |
| 5,345,211 | 9/1994 | Muramatsu et al. | 439/621 |

FOREIGN PATENT DOCUMENTS

| | | |
|---|---|---|
| 3-57852 | 6/1991 | Japan . |
| 4-23048 | 2/1992 | Japan . |
| 6-26141 | 4/1994 | Japan . |

*Primary Examiner*—Paula Bradley
*Assistant Examiner*—Tho D. Ta
*Attorney, Agent, or Firm*—Finnegan, Henderson, Farabow, Garrett & Dunner, L.L.P.

[57] ABSTRACT

A water-proof lower cover is provided on a relay box proper with a fusible link mounted thereon. A guide member having a bottom wall and side walls is formed on the lower cover for guiding a ring terminal inserted by way of a terminal insertion hole of the lower cover. The ring terminal guided by the guide member is electrically connected to a bus bar and the terminal of the fusible link by fastening a bolt to a nut. As a result, the ring terminal inserted into the relay box proper at the portion thereof opposite to the fusible link can be mounted efficiently on the terminal of the fusible link.

5 Claims, 5 Drawing Sheets

TERMINAL STRUCTURE FOR CONNECTION TO ELECTRIC CONNECTION BOX

BACKGROUND OF THE INVENTION

The present invention relates to a terminal structure for connection to an electric connection box, in which the terminal of a fusible link mounted on the case proper of the electric connection box is fastened with the terminal of the mating conductor inserted from outside of the portion of the case proper far from the fusible link, by means of a screw member inserted from a side of the case proper, and a cover is applied to the portion of the case proper where the mating conductor is inserted.

A fusible link box interposed between a power supply and a load of an automobile contains a nut. The fusible link is inserted into the fusible link box from an insertion hole, the cover is opened and a bolt is fastened to the nut. Then, one of the terminals of the fusible link is electrically connected to a bus bar, and the other terminal thereof is electrically connected to a ring terminal at the forward end of the wire harness on the load side.

The fusible link box is formed with a connector housing into which a power connector is inserted. The power connector is electrically connected with one of the terminals of the fusible link through the bus bar. The portion of the fusible link box far from the fusible link insertion hole is closed by a protector, which is mounted after the bolt is fastened and the cover is applied.

Generally, the ring terminal is mounted on the automotive vehicle body assembly line of car manufacturers. The conventional structure described above, however, requires the protector to be removed and the cover to be opened and closed for mounting the ring terminal. The workability of the conventional structure therefore is low, and improvement thereof is desired.

SUMMARY OF THE INVENTION

The object of the invention is to improve the workability of mounting the terminal of the mating conductor on the terminal of a fusible link.

In order to achieve this object, according to the invention, there is provided a structure for terminal connection to an electric connection box, in which the terminal of a fusible link mounted on the case proper of the electric connection box is fastened with the terminal of the mating conductor inserted into the case proper, by means of a screw member inserted from a side of the case proper, a cover is applied to the portion of the case proper where the mating conductor is inserted, an insertion hole is formed in the cover for inserting the mating conductor, and a guide member for guiding the mating conductor is extended from the vicinity of the insertion hole to the portion immediately before the position where the fusible link terminal is fastened by the screw member.

With this configuration, the terminal of the mating conductor can be mounted after applying the cover on the portion of the case proper far from the fusible link insertion hole, thereby improving the workability of the vehicle body assembly line of car manufacturers.

Also, when inserting the mating conductor through the insertion hole from outside of the cover applied on the case proper, the mating conductor is guided to the portion of the fusible link terminal where it is fastened by the screw member, and therefore the mating conductor can be easily mounted on the fusible link by fastening the screw member.

Further, the guide member may include a bottom wall substantially flush with the plane of fastening the fusible link terminal and side walls extending from the side ends of the bottom wall over the inner wall of the cover.

With this configuration, the guide member having a bottom wall and side walls for guiding the mating conductor shuts off the exterior and the interior of the cover from each other, and therefore the water proofness is improved for a higher reliability.

Further, a positioning means for setting the terminal of the mating conductor in a predetermined fastening position may be provided on the case proper in the vicinity of the portion thereof where the screw member is fastened.

With this configuration, when the mating conductor is guided and inserted into the insertion hole, the terminal at the forward end thereof is ready to be fastened by the screw member as soon as it is set in the predetermined fastening position by the positioning means. The work of setting the terminal of the mating conductor in position on the portion fastened by the screw member is thus facilitated.

Furthermore, the positioning means may include a contact surface allowed to contact the forward end of the terminal of the mating conductor and side surfaces formed on the sides of the terminal in contact with the contact surface.

With this configuration, when the mating conductor is guided by the guide member and inserted, the terminal at the forward end of the mating conductor is guided by the sides of the positioning means, so that as soon as the forward end of the terminal is brought into contact with the contact surface, the terminal is set in a predetermined position where it can be fastened by the screw member. The terminal can thus be easily set on the portion where it is to be fastened.

DESCRIPTION OF THE PREFERRED EMBODIMENTS

An embodiment of the invention will be explained below with reference to the drawings.

Figure 1:
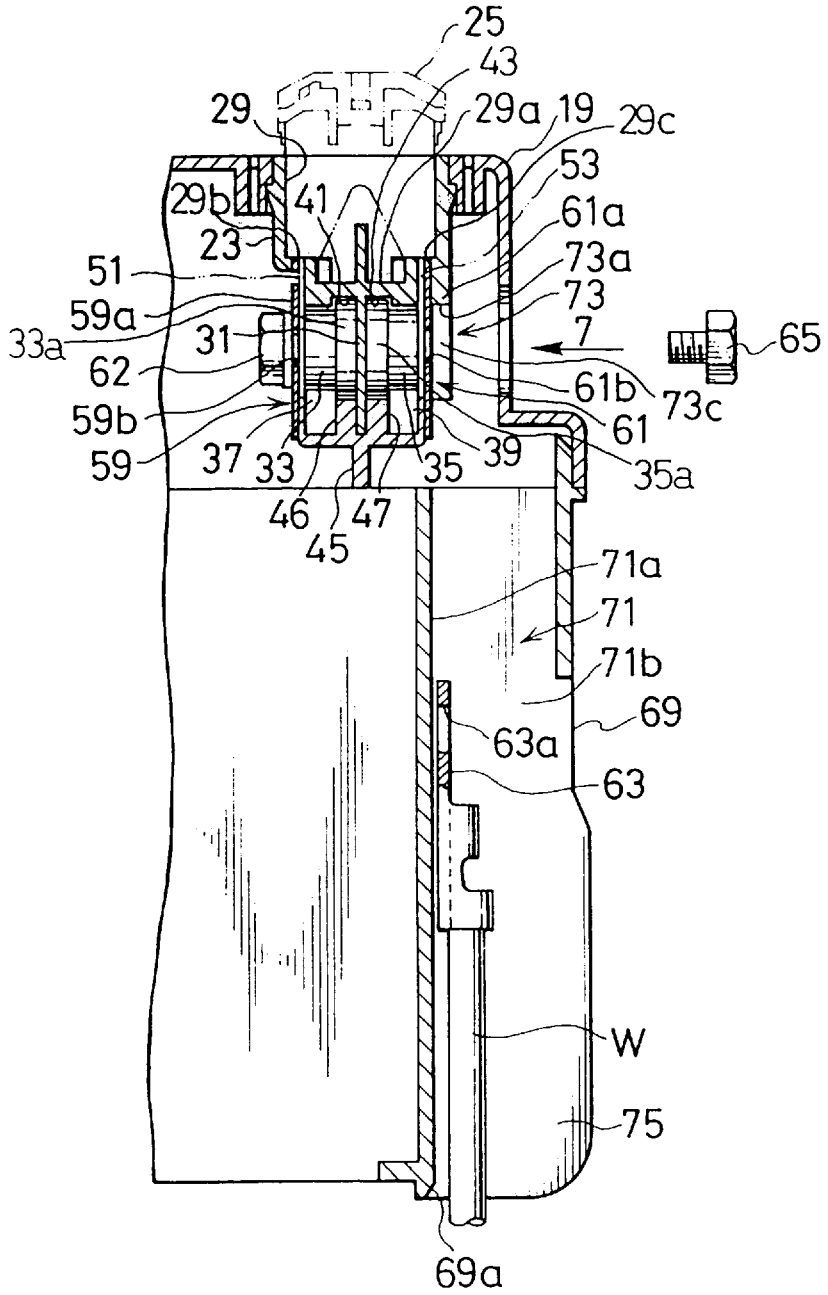
FIG. 1 is a sectional view showing a structure of terminal connection to a relay box according to an embodiment of the invention.
Figure 2:
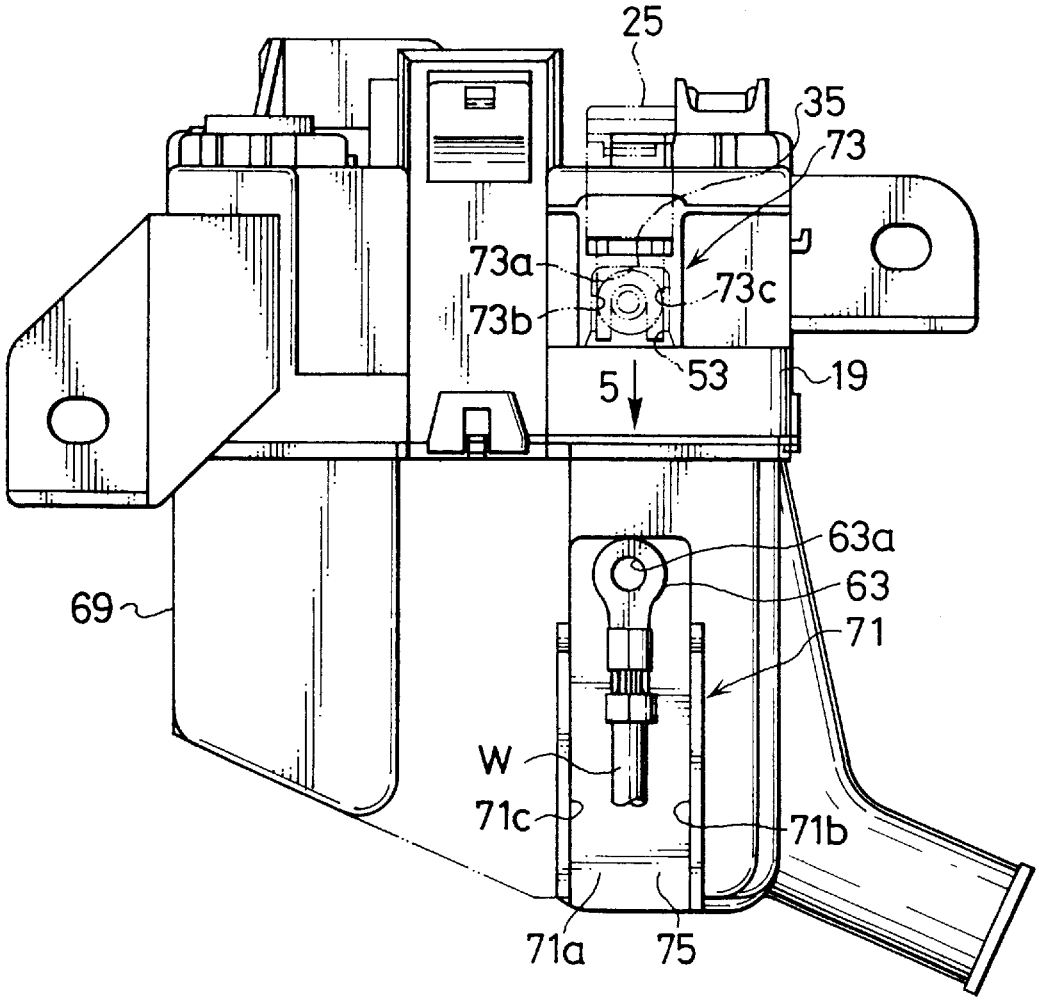
FIG. 2 is a right side view of the structure shown in FIG. 1.
Figure 3:
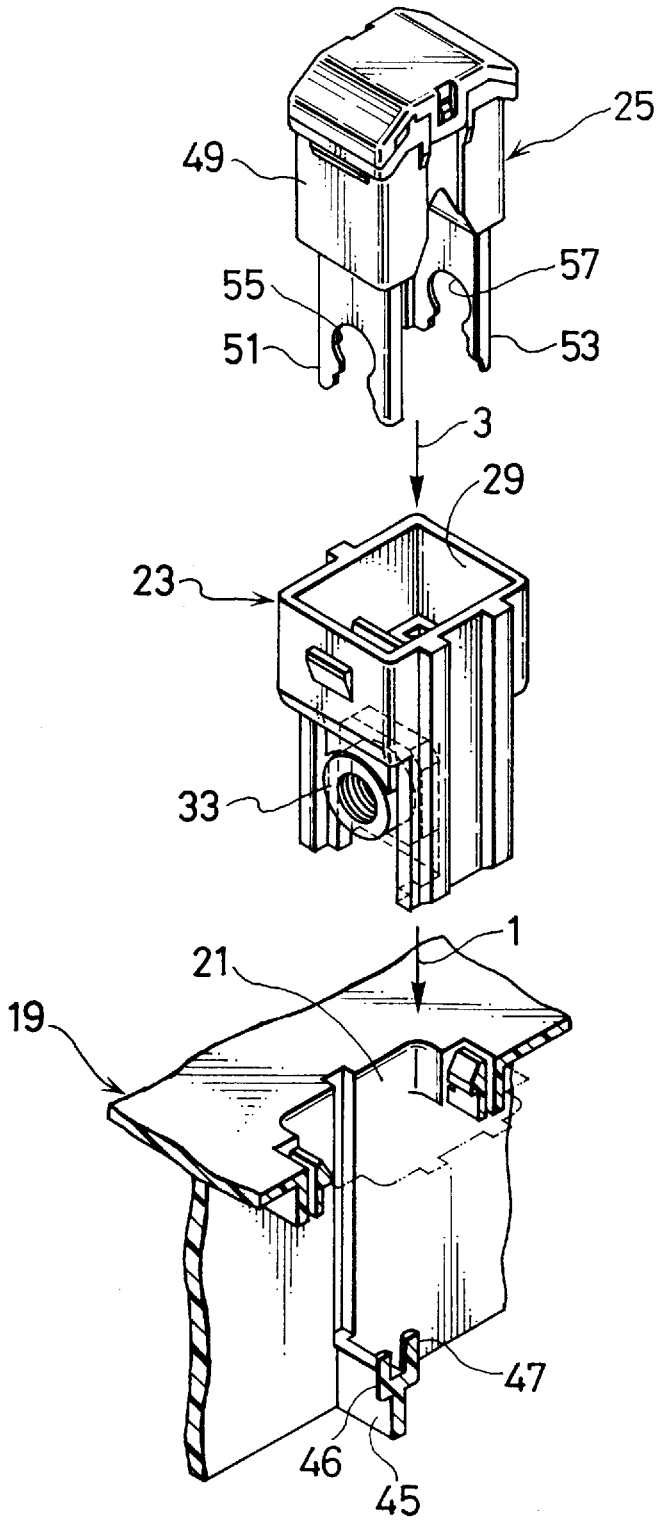
FIG. 3 is an exploded perspective view showing the upper part of the structure shown in FIG. 1.

FIG. 1 is a sectional view of a relay box containing a fusible link as an electric connection box according to an embodiment of the invention, FIG. 2 is a right side view of the same relay box, and FIG. 3 is an exploded perspective view showing the upper part of the structure shown in FIG. 1.

As shown in FIG. 3, a through hole 21 is formed vertically in a relay box proper 19 as a case proper of the relay box.

A fusible link (F/L) block 23 is adapted to be inserted into the through hole 21 from the direction of arrow 1 in FIG. 3. A fusible link 25 is adapted to be inserted into the F/L block 23 from the direction of arrow 3 in FIG. 3.

As shown in FIG. 1, a water-proofing lower cover 69 is mounted on the lower side of the relay box proper 19 far from the portion thereof where the fusible link 25 is inserted.

The F/L block 23 has an insertion recess 29 into which the fusible link 25 is inserted. A partitioning wall 31 extends from the bottom 29*a* of the insertion recess 29 in the direction opposite to the insertion recess 29. Holders 37, 39 of nuts 33, 35, respectively, for securely holding the fusible link 25 are formed on the sides of the partitioning wall 31. The holders 37, 39 have side walls covering the front and back, as viewed with respect to the page, of the nuts 33, 35, respectively. The nuts 33, 35 have flanges 33*a*, 35*a*, respectively. The flanges 33*a*, 35*a* are press-fitted into slots 41, 43 of the holders 37, 39 in the vicinity of the partitioning wall 31 upward in FIG. 1 opposite to the direction in which the fusible link 25 is inserted. The nuts 33, 35 are fitted under pressure using a jig.

A positioning wall 45 adapted to contact and set the partitioning wall 31 of the F/L block 23 in position is formed forward of the portion of the relay box proper 19 where the fusible link 25 is inserted. Nut holders 46, 47 for contacting and holding the nuts 33, 35 mounted on the F/L block 23, are projected upward in a manner to sandwich the partitioning wall 31 on the sides of the positioning wall 45.

As shown in FIG. 3, the fusible link 25 has a pair of terminal members 51, 53 projected from the lower end of the case 49 and formed with bolt insertion holes 55, 57, respectively. The terminal members 51, 53 are inserted into insertion slits 29*b*, 29*c*, respectively, formed in the bottom 29*a* of the F/L block 23 thereby to place the bolt insertion holes 55, 57 in registry with the threaded holes of the nuts 33, 35, respectively.

As shown in FIG. 1, on the other hand, a pair of terminals 59*a*, 61*a* of bus bars 59, 61 are fitted on the sides of the through hole 21 of the relay box proper 19 from the direction (downward in the drawing) opposite to the direction in which the F/L block 23 is inserted. The terminals 59*a*, 61*a* are formed with bolt insertion holes 59*b*, 61*b*, respectively, which are set in registry with the threaded holes of the nuts 33, 35, respectively.

In FIG. 1, the terminal member 51 of the fusible link 25 and the bus bar 59 are secured and electrically connected to each other by fastening the bolt 62 to the nut 33. A ring terminal 63 at the forward end of a wire harness W, on the other hand, is set with the terminal hole 63*a* thereof in registry with the right side portion of the bus bar 61 in FIG. 1. In the case where the bolt 65 is fastened to the nut 35 under this condition, the ring terminal 63, the bus bar 61 and the terminal 53 of the fusible link 25 are securely held and electrically connected to each other. The ring terminal 63 is set on the bus bar 61 by being inserted from a terminal insertion hole 75 formed in the lower cover 69.

The lower cover 69 has a guide member 71 for guiding the ring terminal 63 at the time of insertion. Also, the relay box proper 19 has a positioning means 73 by which the ring terminal 63 of the mating conductor inserted into the F/L block 23 is set in a predetermined position on the bus bar 61 where it can be fastened by a bolt 65 providing a screw member.

Specifically, the terminal insertion hole 75 for the ring terminal 63 is formed in the neighborhood of the guide member 71 over the right side from the lower side of the lower cover 69 in FIG. 1. A large side opening is formed extending almost up to the upper end of the lower cover 69.

The guide member 71 includes a bottom wall 71*a* extending from the lower edge 69*a* forming the terminal insertion hole 75 to the upper end of the lower cover 69 into a state substantially flush with the right side of the bus bar 61, and side walls 71*b*, 71*c* formed from the side edges of the bottom wall 71*a* over the right side inner wall thereof in FIG. 1. The external and internal portions of the lower cover 69 are thus shut off from each other with respect to the terminal insertion hole 75 of the lower cover 69.

Figure 4:
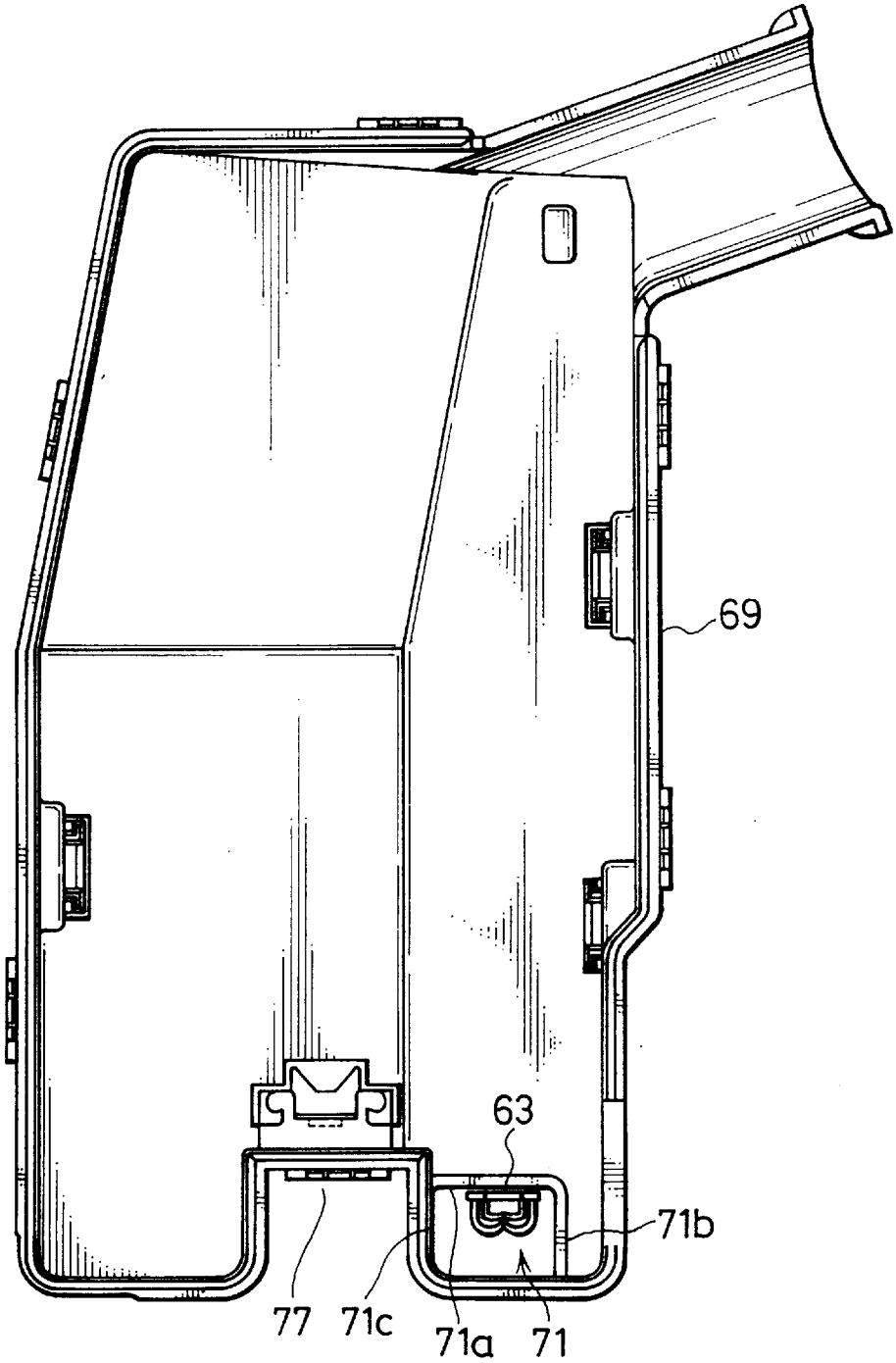
FIG. 4 is a plan view of the lower cover along the arrow 5 in FIG. 2.

FIG. 4 is a plan view of the lower cover 69 in the direction of arrow 5. As shown in FIG. 4, the side wall 71*c* on the left side of the guide member 71 in FIG. 2 is formed of a recess 77 in the lower cover 69.

Figure 5A:
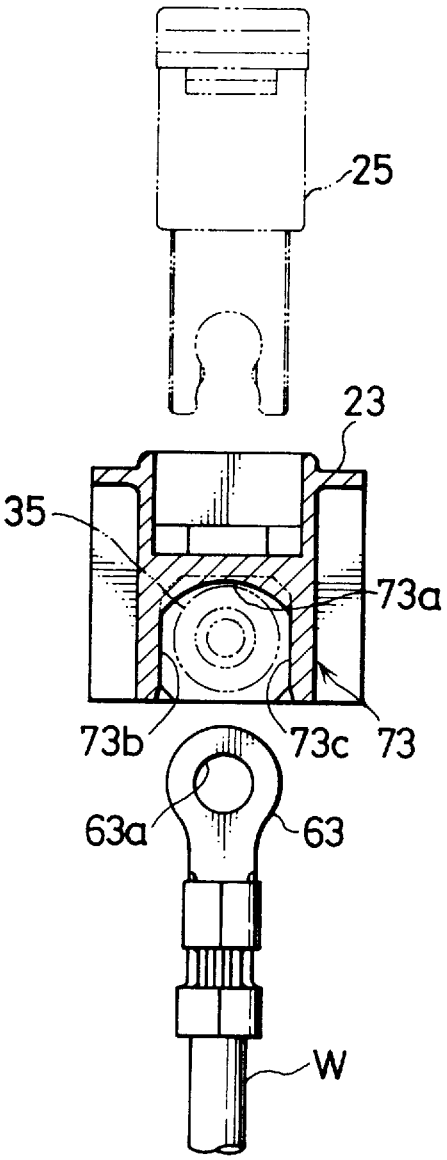
FIG. 5A is a diagram for explaining the fastening portion of the terminal of the fusible link in FIG. 2 in enlarged form and shows the state of the fusible link and a ring terminal before being mounted.
Figure 5B:
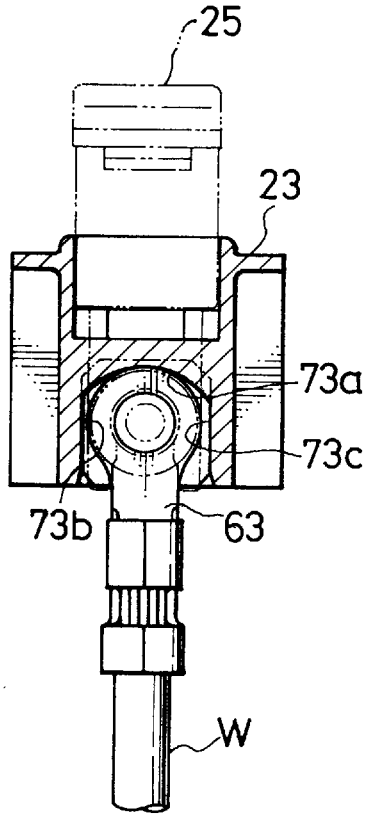
FIG. 5B is a diagram for explaining the fastening portion of the terminal of the fusible link in FIG. 2 in enlarged form and shows the state of the fusible link and a ring terminal after being mounted.

The positioning means 73 of the F/L block 23, on the other hand, is formed extending downward from about the right side end of the bottom 29*a* of the insertion recess 29 for the fusible link 25 in FIG. 1. This positioning means 73, as apparent from FIG. 5A showing the essential parts of FIG. 2 in enlarged form, includes a curved contact surface 73*a* adapted to be in contact with the forward end of the ring terminal 63 and side surfaces 73*b*, 73*c* formed on the sides of the ring terminal 63 in contact with the contact surface 73*a*. As shown in FIG. 5B, the ring terminal 63 is inserted in position in the space defined by the contact surface 73*a* and the side surfaces 73*b*, 73*c*, into which the head of the bolt 65 shown in FIG. 1 is also inserted.

With the structure for terminal connection to an electric connection box configured as described above, the ring terminal 63 can be mounted after applying the cover on the portion of the relay box proper 19 far from the portion thereof where the fusible link 25 is inserted. In other words, the ring terminal 63 can be set on the bus bar 61 with the lower cover 69 mounted thereon thereby to improve the workability of the vehicle assembly line of car manufacturers.

Also, in the case where the ring terminal 63 is set with the fusible link 25 mounted on the F/L block 23 in the relay box proper 19 and with the lower cover 69 mounted on the relay box proper 19, as shown in FIG. 1, the ring terminal 63 is inserted by way of the terminal insertion hole 75 of the lower cover 69 and pressed up to the positioning means 73 along the bottom wall 71*a* of the guide member 71. The ring terminal 63 that has reached the positioning means 73 has the forward end thereof guided by the side surfaces 73*b*, 73*c* into contact with the contact surface 73*a*. In this way, the ring terminal 63 is set in position as shown in FIG. 5B.

The ring terminal 63 thus set in position has the terminal hole 63*a* thereof in registry with the threaded hole of the nut 35. Thus, the bolt 65 inserted into the relay box proper 19 from the direction of arrow 7 in FIG. 1 can be fastened to the nut 35 through the terminal hole 63*a* of the ring terminal 63 and the bolt insertion holes 61*b*, 57 of the bus bar 61 and the fusible link 25, respectively, of the fusible link 25. As a result of fastening the bolt 65 to the nut 35, the fusible link 25, the bus bar 61 and the ring terminal 63 are secured and electrically connected to each other.

As described above, the ring terminal 63 connected to the wire harness W, while being guided by the guide member 71, can be easily set on the portion to be fastened by the bolt 65 with the lower cover 69 mounted on the relay box proper 19. In addition, the ring terminal 63 pressed in almost to the fastening portion on the bus bar 61 is guided by the sides 73*b*, 73*c* of the positioning means 73, so that the forward end of the ring terminal 63 is set in position in contact with the contact surface 73*a*. Therefore, the ring terminal 63 can be very easily and securely mounted.

Further, since the guide member 71 includes the side walls 71*b*, 71*c* in addition to the bottom wall 71*a* and the terminal insertion hole 75 of the lower cover 69 configured in such a manner as to shut off the exterior and interior of the lower cover 69, an improved water proofness and reliability are assured.

What is claimed is:

1. A terminal structure for connection to an electric connection box, comprising:

an electric connection box case;

a fusible link mounted on said case and having a terminal extending into the case;

a mating conductor having a terminal inserted into said case;

a screw member for fastening the terminal of said fusible link and the terminal of said mating conductor in overlapping relation; and a cover applied to a side of the case opposite from said fusible link, the cover having an exterior recessed portion extending through an insertion hole for inserting said mating conductor, and the cover having a guide member for guiding said mating conductor, said guide member extending from said insertion hole to immediately before the terminal of said fusible link to which the terminal of the mating conductor is fastened by said screw member.

2. A terminal structure for connection to an electric connection box according to claim 1, wherein the terminal of said fusible link has a fastening surface, and wherein said guide member includes a bottom wall substantially flush with the fastening surface of the terminal of said fusible link, and side walls extending from side edges of the bottom wall to an inner wall surface of said cover.

3. A terminal structure for connection to an electric connection box according to claim 1, wherein said case includes a positioning means for restricting insertion of the terminal of the mating conductor to a predetermined position to be fastened by said screw member.

4. A terminal structure for connection to an electric connection box according to claim 3, wherein said positioning means includes a contact surface adapted to be in contact with a leading end of the terminal of the mating conductor, and side surfaces located on the sides of said fusible link terminal in contact with said contact surface.

5. A terminal structure for connection to an electric connection box, comprising:

an electric connection box case having an opening;

a fusible link mounted on the case opposite to the opening, the fusible link having a terminal extending into the case;

a mating conductor having at terminal inserted into the case;

a screw member for fastening the terminal of the fusible link and the terminal of the mating connector in overlapping relation; and a cover for covering the opening, the cover having an insertion hole opposite to the fusible link for inserting the terminal of the mating conductor, an exterior recessed portion extending through the insertion hole to the opening of the case, and the cover having a guide member for guiding the terminal of the mating conductor, the guide member extending from the insertion hole through the exterior recessed portion to immediately before the terminal of the fusible link to which the terminal of the mating conductor is fastened by the screw member, the terminal of the mating conductor being guided by the guide member to a position overlapping with the terminal of the fusible link.

* * * * *